US011702797B2

(12) United States Patent
Schuh et al.

(10) Patent No.: US 11,702,797 B2
(45) **Date of Patent: *Jul. 18, 2023**

(54) TISSUE PRODUCTS FORMED FROM MULTI-APEX EMBOSS ELEMENTS AND METHODS FOR PRODUCING THE SAME

(71) Applicant: GPCP IP Holdings LLC, Atlanta, GA (US)

(72) Inventors: Brian J. Schuh, Appleton, WI (US); Steven R. Olson, Madison, WI (US); Michael D. Wishneski, Oconto, WI (US); Eric A. Stuart, Appleton, WI (US)

(73) Assignee: GPCP IP Holdings LLC, Atlanta, GA (US)

( * ) Notice: Subject to any disclaimer, the term of this patent is extended or adjusted under 35 U.S.C. 154(b) by 200 days.

This patent is subject to a terminal disclaimer.

(21) Appl. No.: 17/149,200

(22) Filed: Jan. 14, 2021

(65) Prior Publication Data

US 2021/0285160 A1 Sep. 16, 2021

Related U.S. Application Data

(60) Provisional application No. 62/990,164, filed on Mar. 16, 2020.

(51) Int. Cl.
*D21H 27/32* (2006.01)
*D21H 27/00* (2006.01)
(Continued)

(52) U.S. Cl.
CPC ..... *D21H 27/32* (2013.01); *B31F 1/07* (2013.01); *D21F 11/006* (2013.01); *D21F 11/14* (2013.01);
(Continued)

(58) Field of Classification Search
CPC ..... D21H 27/32; D21H 27/002; D21H 27/02; D21H 27/40; B31F 1/07;
(Continued)

(56) References Cited

U.S. PATENT DOCUMENTS

D65,879 S 10/1924 Vandergaw et al.
D66,160 S 12/1924 Vandergaw et al.
(Continued)

FOREIGN PATENT DOCUMENTS

EP 523382 B1 9/1996
EP 1160378 B1 2/2014
(Continued)

OTHER PUBLICATIONS

English-Language Abstract of JP200268535A, published Nov. 19, 2009.
(Continued)

*Primary Examiner* — Eric Hug

(57) ABSTRACT

Products having improved emboss definition, emboss visibility, and perceived softness are described. The tissue products comprise an emboss pattern including multi-apex, high aspect ratio embossing elements that do not suffer from the prior art issues of bunching, puckering and folding. When included in a multi-ply product, the embossed tissue also possesses less adhesive than prior art patterns resulting in a product with improved softness and drape.

20 Claims, 4 Drawing Sheets

SECTION A-A

(51) Int. Cl.

| | |
|---|---|
| ***D21H 27/02*** | (2006.01) |
| ***D21H 27/40*** | (2006.01) |
| ***D21F 11/14*** | (2006.01) |
| ***B31F 1/07*** | (2006.01) |
| ***D21F 11/00*** | (2006.01) |

(52) U.S. Cl.
CPC ..... *D21H 27/002* (2013.01); *D21H 27/02* (2013.01); *D21H 27/40* (2013.01); *B31F 2201/0733* (2013.01); *B31F 2201/0761* (2013.01); *B31F 2201/0787* (2013.01)

(58) Field of Classification Search
CPC ..... B31F 2201/0733; B31F 2201/0761; B31F 2201/0787; B31F 2201/0738; D21F 11/006; D21F 11/14
USPC ..... 162/117, 362
See application file for complete search history.

(56) References Cited

U.S. PATENT DOCUMENTS

| | | | |
|---|---|---|---|
| 1,863,973 | A | 6/1932 | Ellis, Jr. |
| D114,605 | S | 5/1939 | Turpan |
| 2,177,490 | A | 10/1939 | Kieffer |
| D117,997 | S | 12/1939 | Kaplan |
| D129,008 | S | 8/1941 | Hafner |
| 2,284,663 | A | 6/1942 | Kieffer |
| D154,178 | S | 6/1949 | Ryan |
| D157,619 | S | 3/1950 | Mitschke |
| 4,000,242 | A | 12/1976 | Hartbauer |
| 4,339,088 | A | 7/1982 | Niedermeyer |
| D274,361 | S | 6/1984 | Whitehead |
| 4,483,728 | A | 11/1984 | Bauernfeind |
| 4,637,859 | A | 1/1987 | Trokhan |
| 4,659,608 | A | 4/1987 | Schulz |
| 5,093,068 | A | 3/1992 | Schulz |
| 5,311,814 | A | 5/1994 | Kierson |
| 5,505,818 | A | 4/1996 | Hermans |
| 5,510,002 | A | 4/1996 | Hermans |
| 5,573,830 | A | 11/1996 | Schulz |
| 5,607,551 | A | 3/1997 | Farrington, Jr |
| 5,672,248 | A | 9/1997 | Wendt |
| D390,408 | S | 2/1998 | Kology et al. |
| 6,017,417 | A | 1/2000 | Wendt |
| D419,783 | S | 2/2000 | Tavenas |
| 6,032,712 | A | 3/2000 | Biagiotti |
| D424,359 | S | 5/2000 | Kology et al. |
| D431,746 | S | 10/2000 | Pennington |
| 6,235,373 | B1 | 5/2001 | Graff |
| 6,245,414 | B1 | 6/2001 | Biagiotti |
| 6,277,226 | B1 | 8/2001 | Schulz |
| 6,395,133 | B1 | 5/2002 | McNeil |
| D472,056 | S | 3/2003 | Jahner |
| 6,585,855 | B2 | 7/2003 | Drew |
| 6,599,614 | B1 | 7/2003 | Roussel et al. |
| 6,610,173 | B1 | 8/2003 | Lindsay |
| 6,805,766 | B1 | 10/2004 | Roussel et al. |
| D502,004 | S | 2/2005 | Olson et al. |
| D504,236 | S | 4/2005 | Olson et al. |
| D505,551 | S | 5/2005 | Leisch |
| 6,887,486 | B2 | 5/2005 | Gregoire |
| D507,415 | S | 7/2005 | Boerschinger |
| D527,909 | S | 9/2006 | Leisch |
| D528,306 | S | 9/2006 | Leisch |
| D529,295 | S | 10/2006 | Kressner et al. |
| D540,093 | S | 4/2007 | Lan |
| D581,677 | S | 12/2008 | Yeh |
| 7,624,765 | B2 | 12/2009 | Burazin |
| 7,829,177 | B2 | 11/2010 | Russell et al. |
| D629,213 | S | 12/2010 | Carrier |
| D634,129 | S | 3/2011 | Gerlach |
| D636,607 | S | 4/2011 | Withers |
| D660,011 | S | 5/2012 | Boerschinger |
| D702,951 | S | 4/2014 | Timmerman |
| D714,560 | S | 10/2014 | Xu et al. |
| 8,859,844 | B2 | 10/2014 | Takeuchi et al. |
| D719,742 | S | 12/2014 | Seitzinger |
| 8,999,095 | B2 | 4/2015 | Sauter et al. |
| 9,205,623 | B2 | 12/2015 | Barredo |
| D751,825 | S | 3/2016 | Miller |
| D756,033 | S | 5/2016 | Gordon et al. |
| 9,416,496 | B2 | 8/2016 | Olson |
| D765,425 | S | 9/2016 | Aragon |
| D767,286 | S | 9/2016 | Newman et al. |
| D773,834 | S | 12/2016 | Croteau |
| D799,692 | S | 10/2017 | Buning-weddewer |
| D823,608 | S | 7/2018 | Stephani et al. |
| D860,656 | S | 9/2019 | Barai |
| D864,589 | S | 10/2019 | Austin |
| D865,402 | S | 11/2019 | Morrison et al. |
| D871,082 | S | 12/2019 | Bradley et al. |
| D879,505 | S | 3/2020 | Lopez |
| D897,117 | S | 9/2020 | Gordon et al. |
| D899,101 | S | 10/2020 | Freyre Marquez |
| D911,752 | S | 3/2021 | Grant |
| 2002/0079073 | A1 | 6/2002 | Wilhelm |
| 2003/0000664 | A1 | 1/2003 | Drew |
| 2005/0035492 | A1* | 2/2005 | Weiher ..... B31F 1/07 264/284 |
| 2006/0278356 | A1* | 12/2006 | Boatman ..... B31F 1/07 425/363 |
| 2007/0082184 | A1 | 4/2007 | Hansson |
| 2008/0264275 | A1* | 10/2008 | Wilhelm ..... B31F 1/07 100/210 |
| 2008/0301986 | A1 | 12/2008 | Quin |
| 2009/0068409 | A1 | 3/2009 | Bret et al. |
| 2009/0194244 | A1 | 8/2009 | Harper |
| 2010/0021696 | A1 | 1/2010 | Hill et al. |
| 2010/0038045 | A1 | 2/2010 | Pare et al. |
| 2012/0088076 | A1 | 4/2012 | Glakpe et al. |
| 2014/0141203 | A1 | 5/2014 | Sartini et al. |
| 2015/0101772 | A1 | 4/2015 | Olson |
| 2015/0176218 | A1 | 6/2015 | Maladen et al. |
| 2015/0211187 | A1 | 7/2015 | Mcneil et al. |
| 2018/0360288 | A1 | 12/2018 | Bradley et al. |
| 2018/0363244 | A1 | 12/2018 | Sierra et al. |
| 2019/0024321 | A1 | 1/2019 | Schuh et al. |

FOREIGN PATENT DOCUMENTS

| | | | |
|---|---|---|---|
| GB | 2132141 | B | 12/1986 |
| JP | 200268535 | A | 11/2009 |
| JP | 2009268535 | A | 11/2009 |
| JP | 2013208297 | A | 10/2013 |
| WO | WO1996031652 | A1 | 10/1996 |
| WO | WO1998021410 | A1 | 5/1998 |
| WO | WO2010010580 | A2 | 1/2010 |
| WO | WO2010139759 | A1 | 12/2010 |

OTHER PUBLICATIONS

English-Language Abstract of JP2013208297A, published Oct. 10, 2013.

"To Emboss or Add Decals to Parts or Surfaces," Autodesk Knowledge Network, Feb. 2016. (https://knowledge.autodesk.com/support/inventor-products/learn-explore/caas/CloudHelp/cloudhelp/2016/EN/Inventor-Help/files/GUID-E6848555-B24-4858-8401-84E260771E84-htm.html).

* cited by examiner

SOLID LINE EMBOSSMENT

DUEL APEX LINE EMBOSSMENT

TISSUE PRODUCTS FORMED FROM MULTI-APEX EMBOSS ELEMENTS AND METHODS FOR PRODUCING THE SAME

CROSS REFERENCE TO RELATED APPLICATIONS

This application is based on U.S. Provisional Patent Application No. 62/990,164, filed Mar. 16, 2020. The priority of the foregoing application is hereby claimed and its disclosure incorporated herein by reference in its entirety.

The present disclosure relates to embossed tissue products and methods of making the same. More particularly, the present disclosure relates to an embossed tissue product with improved handfeel. Still more particularly, the present disclosure relates to an embossed tissue product having multi-apex embossing elements. The present disclosure also relates to an emboss pattern of multi-apex, high aspect ratio elements that improve sheet softness without bunching or wrinkling. The present disclosure also relates to a multi-ply tissue product having an emboss pattern of multi-apex, high aspect ratio elements having reduced adhesive load thereby improving softness and drape.

BACKGROUND

Consumers' daily lives are filled with a variety of modern products that are produced solely for their comfort and convenience. Absorbent paper goods take a prominent place in the list of the most used modern conveniences. Typical paper products used by consumers daily include, for example, toilet tissue, paper towel, napkins, wipers and the like.

In the current market where high-end absorbent paper products demand premium prices, consumers are very particular about the products for which they will pay a premium price. Premium products must be strong and absorbent, but also soft, and must be free from any visual defects. Consumer acceptance of premium absorbent paper products is heavily influenced by the perceived softness of the tissue product, including visual perception. Indeed, the consumer's perception of the desirability of one tissue product over another is often based in significant respects on the perceived relative softness of the tissue product; the tissue product that is perceived to be softest is typically perceived to be more acceptable.

Thus, tissue paper used in the production of premium commercial absorbent products should ideally possess a relatively high degree of perceived puffiness and softness. Product attributes are imparted to an absorbent product both during the production of the tissue sheet and during the converting operations that are used to change the tissue web into the final product.

During production, many parts of the process impact the softness, absorbency and the overall bulk of the sheet, but none more than the manner in which the sheet is dried. Drying of the web on a structured drying fabric without compaction results in the highest levels of bulk in the tissue sheet which translates to the greatest perceived softness. Through-air-drying has become the measured standard for the manufacture of premium grade tissues since it produces a tissue sheet having bulk, softness and absorbency. Because of the high energy demands of TAD, other structured tissue technologies have been developed. These technologies all use special fabrics or belts to impart a structure to the sheet but use significantly lower nip loads for dewatering than conventional wet pressing, for example, advanced tissue molding system "ATMOS" used by Voith, or energy efficient technologically advanced drying "eTAD", used by Georgia Pacific. Many of the newer mills are moving to TAD or some variation for producing a structured tissue.

While these highly bulky sheets are preferred by consumers, their characteristics have created issues that must be addressed to produce a successful premium product. By way of example, since the tissue base sheet is much bulkier than compactively dried tissue, these sheets result in larger tissue rolls that would not fit on consumer's standard toilet tissue holders. The industry moved to more tightly wound products, e.g., "two rolls in one," that would satisfy the consumer's desires.

Other characteristics of these highly bulky sheets have also caused production methods to be modified to achieve desirable consumer products. Two such characteristics include higher caliper and increased machine direction stretch. While these characteristics are important for producing a premium commercial product, both of these attributes impact one's ability to emboss the base sheet.

Embossing always affects the attributes of the final product. Generally embossing makes the tissue softer and bulkier, but embossing necessarily trades softness for strength. Balancing the softness improvements while minimizing the strength losses is an important characteristic in the area of premium tissue production. In many instances, the specific pattern is chosen to create certain balanced characteristics in the final product. As embossing patterns have become common place in the production of premium products, patterns have been developed that improve the softness gain/strength loss relationship and create softer and stronger products.

Products having longer (high aspect ratio) elements are generally thought to feel softer to consumers. The hands of the consumer glide more easily along the lines. Accordingly, high aspect ratio elements can be useful in improving softness in premium paper products. However, application of these patterns often results in tissue bunching when embossing these highly bulky sheets produced by newer tissue production methods.

These highly bulky structured tissues generally have an elongation in the MD direction of greater than about 10%. High aspect ratio elements often align either fully or partially in the machine direction. These alignments in combination with the increased stretch of the base sheet increases the occurrence of bunching and wrinkling. To avoid these visual defects most patterns used in premium products are assembled from a series of shorter dot or dash shaped elements and are routinely offset from the machine direction. The high levels of stretch in these base sheets exacerbate the problem of bunching and cause runnability issues due to the level of wrinkling and folding, if they are embossed with anything other than patterns having relatively short elements.

Because of these significant limitations on the type of emboss pattern that can be used with high stretch premium products, manufacturers are constantly looking at new patterns in an attempt to improve product attributes. Unfortunately, the solution to bunching and puckering to break the pattern up into shorter elements destroys the high aspect ratio nature of the pattern, thus negating the improved emboss definition and/or visibility and/or perceived softness imparted by the longer embossments to the sheet.

The tissue products as described herein comprise high aspect ratio emboss elements including a multi-apex feature that can either absorb some of the added stretch or can dissipate the stretched tissue back into the sheet. The inclusion of a multi-apex can thus reduce tissue bunching without the need to change the emboss pattern, thereby opening up a myriad of patterns that have high aspect ratio emboss elements. The embossing methods as described can result in a tissue product having improved emboss definition and/or visibility and/or perceived softness.

In addition to resolving the bunching issue associated with high aspect ratio embossing patterns, the use of a multi-apex feature also addresses another limitation that has been associated with larger embossing elements, adhesive load. When plies of tissue are adhesively bonded, the adhesive is usually applied to the tops (apex) of the emboss elements. The high amount of adhesive used on larger and linear embossment make the products feel harsher. However, the addition of a multi-apex feature as described herein, reduces the contact surface for the adhesive thereby reducing the adhesive load and preserving additional softness in the premium product.

SUMMARY OF THE DISCLOSURE

Disclosed herein are adhesively bonded multi-ply embossed tissue products comprising at least two tissue webs, wherein at least one of the tissue webs is embossed with an embossing pattern comprising at least one elongated emboss element having a base and an apex and an aspect ratio of at least about 5, wherein the apex of the emboss element comprises at least one channel running the length of the elongated emboss element dividing the apex into at least two sections.

Being able to emboss a structured base sheet with a pattern comprising high aspect ratio emboss elements without excessive bunching or wrinkling opens up a much broader category of embossing patterns that have heretofore not been used in premium tissue production. In addition to reducing the wrinkling and bunching of the product, the multi-apex nature of the emboss elements disclosed herein beneficially reduce the adhesive load.

In some embodiments, the at least two tissue webs are bonded by adhesive applied to the at least two sections of the apex of the at least one elongated emboss element and the at least two webs are not bonded at the at least one channel.

The disclosure also relates to a method of producing a multi-ply paper product comprising, forming a base sheet, embossing the base sheet with a pattern that includes at least one elongated emboss element having a base and an apex and an aspect ratio of at least about 5, wherein the apex of the emboss element comprises at least one channel running the length of the elongated emboss element dividing the apex into at least two sections, and combining the embossed base sheet with at least one second base sheet by adhesive to form a multi-ply product.

In some embodiments, the embossing method comprises embossing a base sheet between a steel roll bearing a pattern and a rubber roll, wherein the pattern on the steel roll includes at least one elongated emboss element having a base and an apex and an aspect ratio of at least about 5, wherein the apex of the emboss element comprises at least one channel running the length of the elongated emboss element dividing the apex into at least two sections.

Additional advantages of the described methods and products will be set forth in part in the description which follows, and in part will be obvious from the description, or may be learned by practice of the disclosure. The advantages of the disclosure will be realized and attained by means of the elements and combinations particularly pointed out in the appended claims.

It is to be understood that both the foregoing general description and the following detailed description are exemplary and explanatory only and are not restrictive of the invention, as claimed. The accompanying drawings, which are incorporated in and constitute a part of this specification, illustrate several embodiments and together with the description, serve to explain the principles of the disclosure.

DETAILED DESCRIPTION

Figure 1:
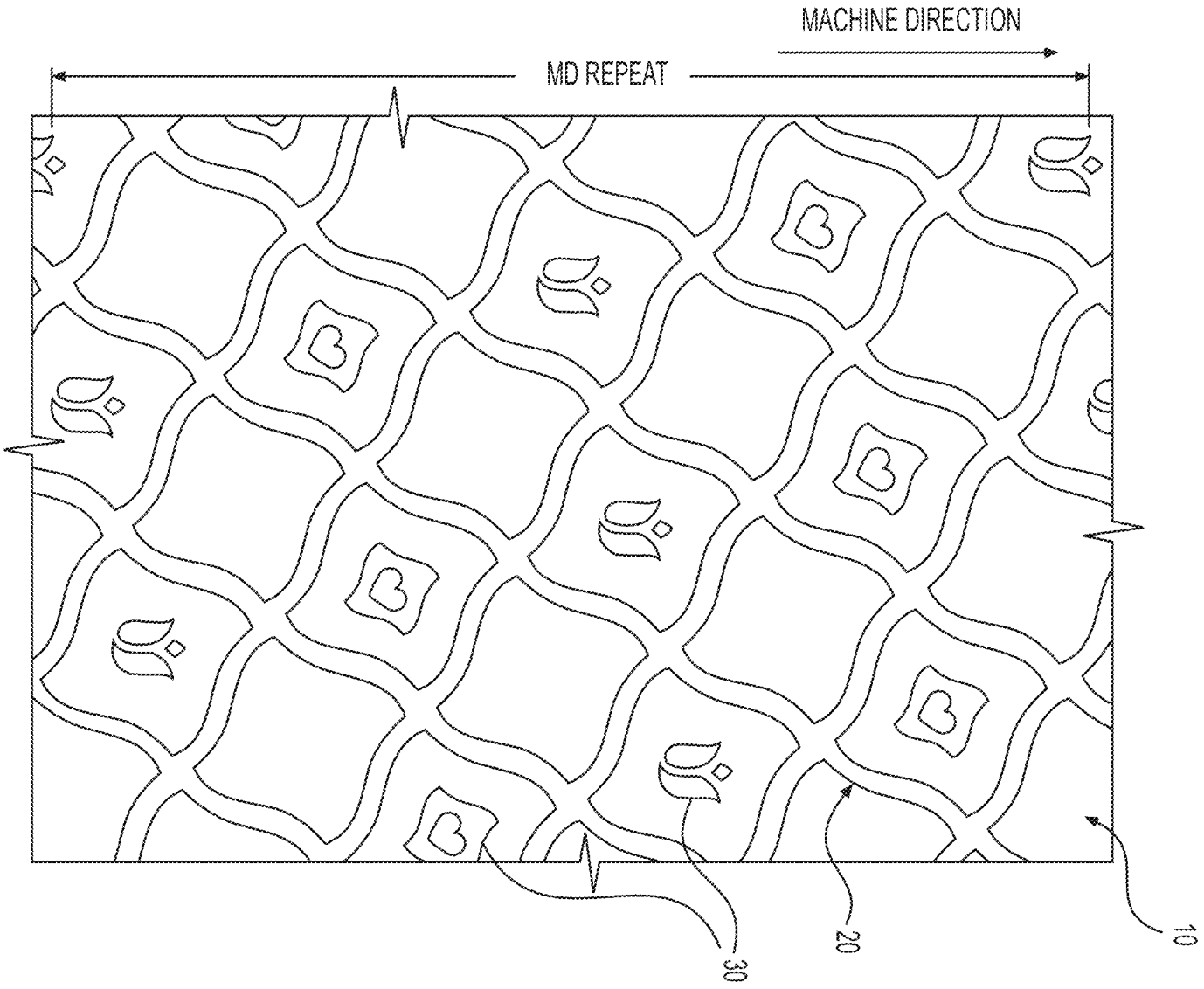
FIG. 1 illustrates an exemplary emboss pattern according to one embodiment of the disclosure including elongated emboss elements with an aspect ratio of at least about 5.

Reference will now be made in detail to certain exemplary embodiments, examples of which are illustrated in the accompanying drawings. Wherever possible, the same reference numbers will be used throughout the drawings to refer to the same or like items.

The present disclosure relates to paper products having at least one tissue web comprising an emboss pattern comprising at least one elongated emboss element having a base and an apex and an aspect ratio of at least about 5, wherein the apex of the emboss element comprises at least one channel running the length of the elongated emboss element dividing the apex into at least two sections. Not wishing to be bound by theory, it is believed that the multi-apex feature reduces the web tension at the micro level allowing the web to reabsorb any stretching that occurs during embossment of the high aspect ratio emboss elements. The multi-apex emboss elements are believed to have improved micro elasticity providing additional area in which the bunch or pucker can be dissipated, and the multi-apex feature absorbs the stretch better thereby reducing the formation of a pucker or bunch in the stretched web.

The embossing technique as described can be used to produce tissue products from base sheets produced using conventional wet pressing, or the newer techniques for making premium grades tissues, as discussed infra. In conventional wet pressing, the nascent web is transferred to a papermaking felt and is dewatered by passing it between the felt and a press roll under pressure. The web is then pressed by a suction press roll against the surface of a rotating Yankee dryer cylinder that is heated to cause the paper to substantially dry on the cylinder surface. The moisture within the web as it is laid on the Yankee surface causes the web to transfer to the surface. Liquid adhesive may be applied to the surface of the dryer, as necessary, to provide substantial adherence of the web to the surface. The web is then removed from the Yankee surface with a creping blade. The creped web is then passed between calendar rollers and rolled up to be used as a base sheet in the downstream production of a tissue product. This method of making tissue sheets is commonly referred to as "wet-pressed" because of the compactive method used to dewater the wet web.

These processes all share the characteristic that the sheet is dewatered under pressure. While one conventional wet pressing operation is described above, the system is only exemplary and variations on the described system will be readily apparent to the skilled artisan.

In through-air-drying ("TAD") methods the nascent web is partially dewatered using vacuum suction. Thereafter, the partially dewatered web is dried without compression by passing hot air through the web while it is supported by a through-drying fabric. However, as compared to conventional wet pressing, through-air-drying is expensive in terms of capital and energy costs. Because of the consumer perceived softness of these products and their greater ability to absorb liquid than webs formed in conventional wet press processes, the products formed by the through-air-drying process enjoy an advantage in consumer acceptance. Because it does not suffer from compaction losses, through-air-dried tissue base sheets currently exhibits the highest caliper, i.e., bulk, of any base sheet for use in premium absorbent products.

Alternatives to TAD include processes that use special fabrics or belts to impart a structure to the sheet, but which continue to use some limited nip load. In connection with the production of structured sheets, fabric molding has also been employed as a means to provide texture and bulk. In this respect, there is seen in U.S. Pat. No. 6,610,173 to Lindsay et al. a method for imprinting a paper web during a wet pressing event which results in asymmetrical protrusions corresponding to the deflection conduits of a deflection member. The '173 patent reports that a differential velocity transfer during a pressing event serves to improve the molding and imprinting of a web with a deflection member. The tissue webs produced are reported as having particular sets of physical and geometrical properties, such as a pattern densified network and a repeating pattern of protrusions having asymmetrical structures. With respect to wet-molding of a web using textured fabrics, see, also, the following U.S. Pat. Nos. 6,017,417 and 5,672,248 both to Wendt et al.; U.S. Pat. Nos. 5,505,818 and 5,510,002 to Hermans et al. and U.S. Pat. No. 4,637,859 to Trokhan. With respect to the use of fabrics used to impart texture to a mostly dry sheet, see U.S. Pat. No. 6,585,855 to Drew et al., as well as United States Publication No. US 2003/0000664 A1.

As used herein "structured tissues" or "structured webs" refer to tissue made by TAD or other structured tissue technologies. These processes all share the characteristic that the sheet is dewatered under limited or no compaction. While one through-air-drying operation is described above, the system is only exemplary and variations on the described system will be readily apparent to the skilled artisan.

As used herein "web," "sheet," "tissue," "nascent web," "tissue product," "base sheet" or "tissue sheet," can be used interchangeably to refer to the fibrous web during various stages of its development. Nascent web, for example, refers to the embryonic web that is deposited on the forming wire. Once the web achieves about 30% solids content, it is referred to as a tissue, or a sheet or a web. Post production, the single-ply of tissue is called a base sheet. The base sheet may be combined with other base sheets to form a tissue product or a multi-ply product.

The base sheet for use in the products of the present disclosure may be made from any art recognized fibers. Papermaking fibers used to form the absorbent products of the present disclosure include cellulosic fibers, commonly referred to as wood fibers. Specifically, the base sheet of the disclosure can be produced from hardwood (angiosperms or deciduous trees) or softwood (gymnosperms or coniferous trees) fibers, and any combination thereof. Hardwood fibers include, but are not limited to maple, birch, aspen and eucalyptus. Hardwood fibers generally have a fiber length of about 2.0 mm or less. Softwood fibers include, but are not limited to, spruce and pine. Softwood fibers exhibit an average fiber length of about 2.5 mm. Cellulosic fibers from diverse material origins may also be used to form the web of the present disclosure. The web of the present disclosure may also include recycle or secondary fiber. The products of the present disclosure can also include synthetic fibers as desired for the end product.

Papermaking fibers can be liberated from their source material by any one of a number of chemical pulping processes familiar to one experienced in the art including sulfate, sulfite, polysulfite, soda pulping, etc. The pulp can be bleached as desired by chemical means including the use of chlorine, chlorine dioxide, oxygen, etc. Alternatively, the papermaking fibers can be liberated from source material by any one of a number of mechanical/chemical pulping processes familiar to anyone experienced in the art including mechanical pulping, thermomechanical pulping, and chemi-thermomechanical pulping. These mechanical pulps can be bleached, if one wishes, by a number of familiar bleaching schemes including alkaline peroxide and ozone bleaching.

In a typical process, the fiber is fed into a headbox where it will be admixed with water and chemical additives, as appropriate, before being deposited on the forming wire. The chemical additives for use in the formation of the base sheets can be any known combination of papermaking chemicals. Such chemistry is readily understood by the skilled artisan and its selection will depend upon the type of end product that one is making. Papermaking chemicals include, for example, one or more of strength agents, softeners and debonders, creping modifiers, sizing agents, optical brightening agents, retention agents, and the like. The method used in the instant disclosure to reduce fiber bunching should not generally be affected by the chemistry of the base sheet.

While exemplary formation of the base sheet is detailed above, products using any base sheet can benefit from being embossed with a pattern as described herein. The base sheet for use in the present disclosure can include base sheets that are creped or uncreped, homogeneous or stratified, wet-laid or air-laid and may contain up to 100% non-cellulose fibers.

In a typical process, the base sheet is rolled and awaits converting. Converting refers to the process that changes or converts base sheets into final products. Typical converting in the area of tissue and towel includes embossing, perforating, gluing, and plying.

Unless indicated otherwise, as used herein, "an emboss, (the noun)", "embossing element," "embossment," "boss," are all used interchangeably and refer to an element within an embossing pattern that causes the base sheet to form protrusions or recessions in the paper sheet, or to the protrusions or recessions in the sheet themselves.

Figure 3:
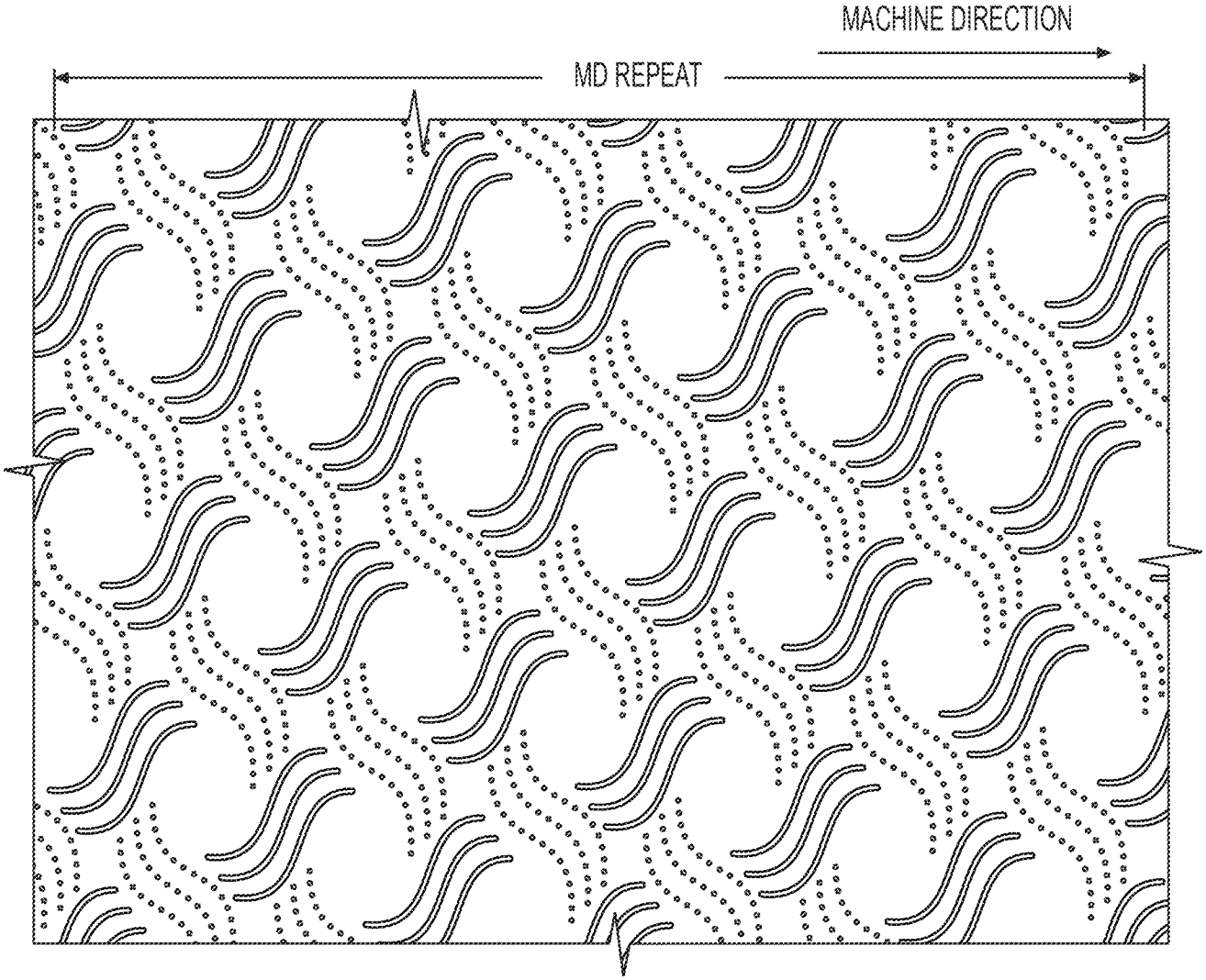
FIG. 3 illustrates an exemplary emboss pattern according to another embodiment of the disclosure including elongated emboss elements with an aspect ratio of at least about 5.

Embossing patterns of the instant disclosure are made up of elements that are arranged to create a design. The particular pattern may be chosen based on a myriad of considerations, including those that are functional as well as those that are non-functional aesthetic and ornamental, for example the patterns shown in FIGS. 1 and 3. The exemplary patterns disclosed herein are not limiting and are not the only patterns that will exhibit the claimed utility. For rolled products, the pattern would generally traverse the entire width and length of the base sheet. Emboss patterns for use in the instant disclosure may be an indication of source of the goods or may contain one or more design elements that are trademarks or other source identifiers, or decorative elements referred to herein as a signature embosses. In FIG. 1, signature emboss elements are shown as hearts and flowers. In some embodiments, the embossing patterns of the instant disclosure may contain one or more continuous elements. As used herein "continuous element" refers to an element that is a closed loop. The loop may be any shape or design. In FIG. 1, continuous emboss elements are shown as wavy diamonds that form a series of cells.

In some embodiments, the embossing patterns may have one or more elements that align in the MD direction of the sheet. The patterns can include MD direction patterns that are not offset, but which are square with the paper web, i.e., at a 90° angle to the paper's edge. The patterns can include offset or other varied patterns that have elements that periodically align in the MD direction of the sheet.

According to the present invention, the paper products have at least one tissue web comprising an emboss pattern comprising at least one elongated emboss element having a base and an apex and an aspect ratio of at least about 5, wherein the apex of the emboss element comprises at least one channel running the length of the elongated emboss element dividing the apex into at least two sections.

As used herein, "aspect ratio" refers to the size of an emboss element based upon its width and length. For example, an embossing element with an aspect ratio of 5 would be 5 times as long as it is wide. In some embodiments, the emboss pattern comprising at least one elongated emboss element having an aspect ratio of at least about 10, for example, at least about 20, at least about 30, at least about 50, or at least about 100. As used herein, "high aspect ratio elements" refers to elements having an aspect ratio of at least about 5.

According to the present invention, the apex of the at least one emboss element comprises at least one channel running the length of the elongated emboss element dividing the apex into at least two sections. In some embodiments, the at least one emboss element comprises one channel running the length of the elongated emboss element dividing the apex into two sections to form a dual-apex. In some embodiments, the at least one emboss element comprises two channels running the length of the elongated emboss element dividing the apex into three sections to form a tri-apex. In some embodiments, the at least one emboss element may comprise more than two channels running the length of the elongated emboss element dividing the apex into more than three sections.

The products as described herein will be discussed with respect to the embodiment depicted; however, other products and product types can avail themselves of the advantages associated with the methods and embossments described.

FIG. 1 depicts a pattern 10 comprised of continuous emboss elements 20 and signature elements 30. In the embodiment shown, both the continuous emboss elements 20 and the signature elements 30 are high aspect ratio elements, having a length of at least 5 times the width. As seen in FIG. 1, the pattern 10 is offset from the machine direction; however, because the individual embossments have segments that align with the machine direction, this off-set fails to entirely prevent bunching of the web around the emboss elements during embossing. The use of the multi-apex nature of the emboss elements as described herein resolved the bunching and pucker problem without breaking the pattern up into smaller embossments.

Figure 2A:
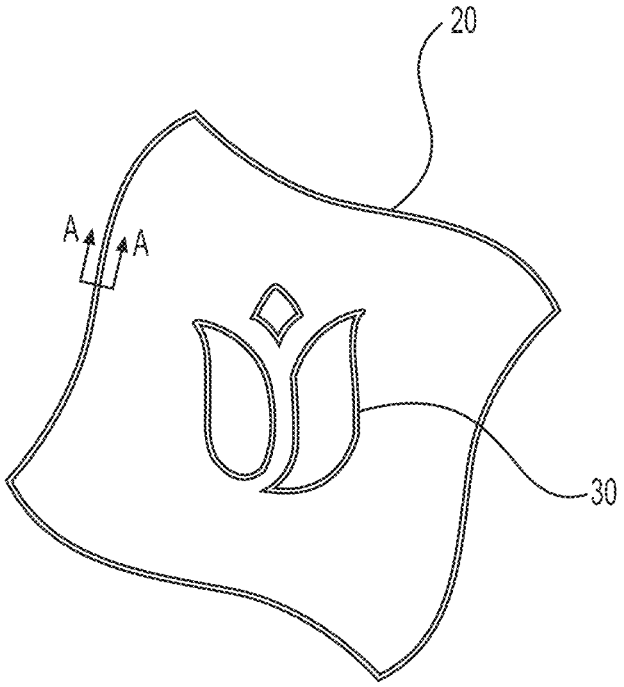
FIG. 2A illustrates an enlarged single lattice element of FIG. 1.
Figure 2B:
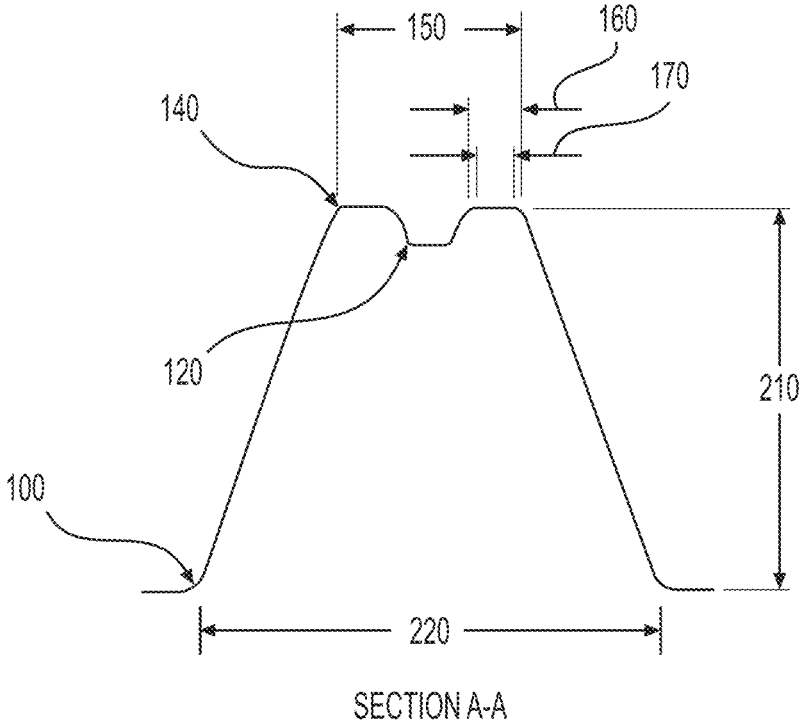
FIG. 2B illustrates an enlarged cross section of the emboss element at line A-A in FIG. 2A.

According to this embodiment seen in FIGS. 1 and 2A-2B, the continuous emboss elements were altered to modify the apex of the elements. FIG. 2A is an enlarged view of a signature element 30 and a continuous emboss element 20 as seen in the pattern of FIG. 1. FIG. 2B is the cross section of the continuous emboss element 20 at line A-A as seen in FIG. 2A. The embossment in FIG. 2B has a base 100 of width 220, a height 210, and an apex 140. The apex 140 includes a channel 120 that divides the apex into two sections, each having a width 160 and a contact area 170. The width of the two sections, plus the channel make up the entire width 150 of the apex 140. The change to include the channel 120 in the top of continuous emboss elements 20 according to the present invention provide sufficient tension release to abate the formation of the puckers and bunches.

Figure 2C:
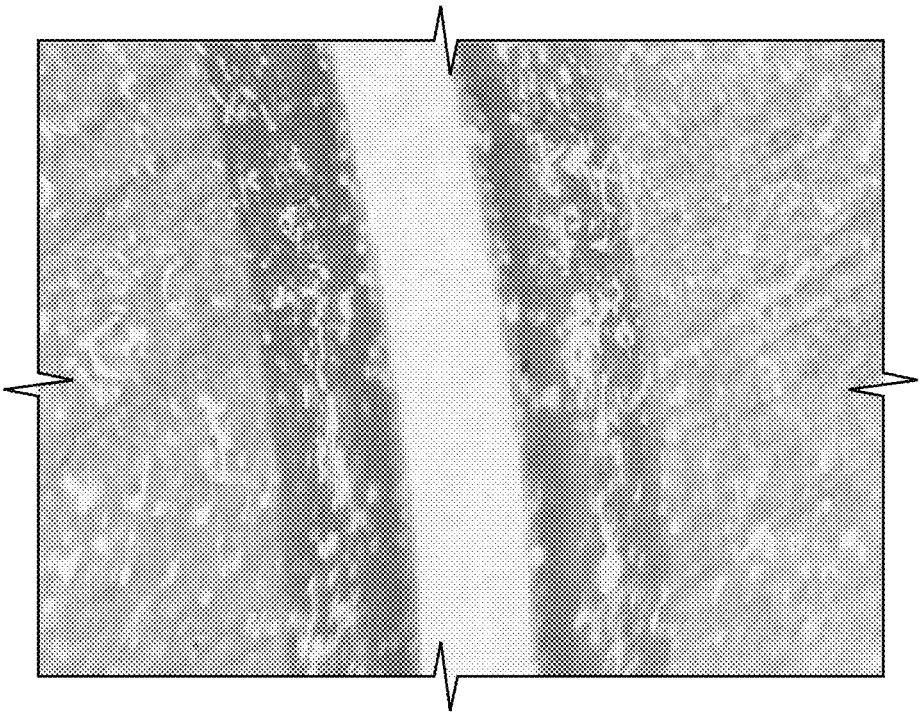
FIG. 2C is a top view perspective of a traditional solid line embossment with only a single apex according to the prior art.
Figure 2D:
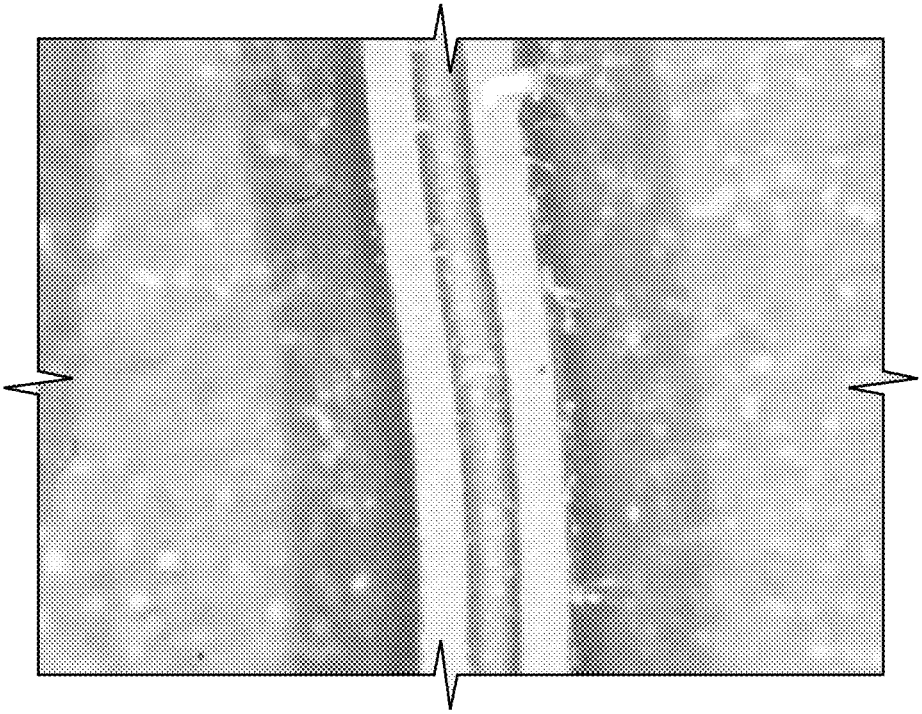
FIG. 2D is a top view perspective of an exemplary dual-apex line embossment according to FIG. 2B.

FIG. 2C is a top view perspective of a traditional solid line embossment with only a single apex according to the prior art. FIG. 2D is a top view perspective of an exemplary dual-apex line embossment according to FIG. 2B.

As will be readily apparent to the skilled artisan after reading this disclosure, the changes to the element apex can take a variety of shapes or number of apex, so long as the element includes at least one channel running the length of the elongated emboss element dividing the apex into at least two sections.

In some embodiments, the emboss elements have a width at the base of the emboss element of from about 0.05 inches to about 0.09 inches, for example from about 0.06 inches to about 0.09 inches, for example, from about 0.065 inches to about 0.085 inches.

In some embodiments, the elements have a width at the top of the element of from about 0.01 inches to about 0.08 inches, for example, from about 0.01 to about 0.04 inches, for example, from about 0.015 to about 0.025 inches.

In some embodiments, the width of the at least one channel 120 at the top of the element comprises at least about 10% of the total width 150 of the apex 140, for example, at least about 20%, at least about 35% or at least about 50%. In some embodiments, the width of the at least one channel 120 at the top of the element comprises from about 20% to about 50% of the total width 150 of the apex 140.

In some embodiments, the angle of the sidewalls of the emboss elements is between about 10 and about 30 degrees, for example, between about 13 and 25 degrees, for example, about 15 to about 20 degrees, for example, about 20 degrees. When embossing with a rubber backing roll, the higher the angle of the sidewall, the more rubber the element contacts thereby causing more stretch and exacerbating the bunching issue.

In some embodiments, the embossing elements are embossed to a depth of from 0.050 to about 0.075 inches, for example, to a depth of about 0.055 to about 0.070 inches.

In some embodiments the emboss depth is from about 0.05 inches to about 0.09 inches, for example, from about 0.06 inches to about 0.07 inches.

Three characteristics generally impact the need for abatement and what type of abatement should be selected. The first is length of the embossing element. The industry typically prevents puckers and bunching by keeping the emboss elements small, e.g., having an aspect ratio of about 2. The break between the elements creates a natural abatement for the extra fiber. However, if high aspect ratio embossing elements are used, the longer the element, the greater the likelihood of bunching. The longer the embossing element, the more time the fiber has to accumulate along the element.

The second characteristic is the orientation of the element. The greater the machine direction alignment of the embossing elements or pattern, the more likely the pattern will cause bunching and puckering. Fiber accumulation is exacerbated when the emboss element aligns with the MD stretch of the paper. The greater the MD alignment, the more fiber gets carried along with the emboss element and the more likely the sheet will bunch or pucker.

Finally, sheet characteristics plays a significant role in bunching and puckering. The more stretch the sheet has, the more fiber that will be moved in the MD direction. The thicker the sheet or the higher the basis weight, the more fiber there is to rearrange and therefore carry along.

Unless otherwise specified, "basis weight", "BWT," "BW," and so forth, refers to the weight (lbs) of a 3000 square-foot ream of product (basis weight may also be expressed in g/m$^2$ or gsm). Likewise, "ream" means a 3000 square-foot ream, unless otherwise specified. TAPPI LAB-CONDITIONS refers to TAPPI T-402 test methods specifying time, temperature and humidity conditions for a sequence of conditioning steps. The product of the present disclosure has a single base sheet basis weight of from about 7 to about 35 lbs/ream. In some embodiments, the product has a basis weight of from about 9 to about 18 lbs/ream, for example, from about 9 to about 15 lbs/ream, for example, from about 10 to about 14 lbs/ream, for example about 11 to about 13 lbs/ream.

The product of the present disclosure has a caliper of from at least about 80 mils/8 sheets to about 300 mils/8 sheets, for example, from about 100 mils/8 sheets to about 250 mils/8 sheets, for example, from about 80 mils/8 sheets to about 200 mils/8 sheets, for example, 100 mils/8 sheets to about 160 mils/8 sheets, for example, 110 mils/8 sheets to about 150 mils/8 sheets.

Calipers reported herein are 8-sheet calipers unless otherwise indicated. The sheets are stacked, and the caliper measurement taken about the central portion of the stack. Preferably, the test samples are conditioned in an atmosphere of 23°±1.0° C. (73.4°±1.8° F.) at 50% relative humidity for at least about 2 hours and then measured with a Thwing-Albert Model 89-II-JR or Progage Electronic Thickness Tester with 2-in (50.8-mm) diameter anvils, 539±10 grams dead weight load, and 0.231 in./sec descent rate. For finished product testing, each sheet of product to be tested must have the same number of plies as the product is sold. For base sheet testing off of the paper machine reel, single plies are used with eight sheets being selected and stacked together. Specific volume is determined from basis weight and caliper.

Dry tensile strengths (MD and CD), stretch, ratios thereof, break modulus, stress and strain are measured with a standard Instron test device or other suitable elongation tensile tester which may be configured in various ways, typically using 3 or 1 inch wide strips of tissue or towel, conditioned at 50% relative humidity and 23° C. (73.4° F.), with the tensile test run at a crosshead speed of 2 in/min. Break modulus is the ratio of peak load to stretch at peak load.

GMT refers to the geometric mean tensile strength of the CD and MD tensile. Tensile energy absorption (TEA) is measured in accordance with TAPPI test method T581 om-17. The product of the present disclosure has a Geometric Mean Tensile Strength (GMT) of from about 400 to about 4500, for example 600 to about 3500, for example, from about 700 to about 3200, for example, from about 700 to about 2500, for example, from about 750 to about 2500, for example, from about 750 to about 1200, for example, from about 825 to 875.

In some embodiments, the products are made from base sheets having a MD elongation (stretch) of at least about 10%, for example, at least about 12%, for example, at least about 14%, for example, for at least about 17%, for example, from about 10% to about 40%, for example, from about 15% to about 30%.

In some embodiments, the base sheets are dried and rolled and subsequently embossed to provide an emboss pattern in accordance with the present disclosure. The plies are then married to form the multi-ply product. In some embodiments, the plies are concurrently embossed and plied to form the multi-ply product.

In some embodiments, the product is plied using an adhesive. Any art recognized adhesive or glue can be used to adhere the plies of the multi-ply product. In addition to resolving the bunching issue associated with high aspect ratio embossing patterns, the use of a multi-apex feature can also beneficially reduce adhesive load. When plies of tissue are adhesively bonded, the adhesive is usually applied to the tops (apex) of the emboss elements. Where a multi-apex feature is used according to the present invention, the adhesive may be applied to the multi-apex portions, but may be omitted from the one or more elongated channels running the length of the embossments. This results a reduction in the contact surface for the adhesive compared to the same embossments with only a single apex, thereby reducing the adhesive load and preserving additional softness in the premium product.

In some embodiments, adhesive is applied to only the multi-apex portions 140 of the high aspect ratio embossments and is not applied to the one or more channels 120 running the length of the high-aspect ratio embossments. In some embodiments, when a ply having an emboss pattern having multi-apex, high aspect ratio embossments is joined with another ply, the two plies are bonded only at the multi-apex portions 140 of the high aspect ratio embossments and not at the one or more channels 120 running the length of the high-aspect ratio embossments.

The multi-ply product of the present disclosure can have a ply bond of at least about 1 g, for example from about 1 g to about 40 g, for example at least about 3 g, for example, from about 3 g to about 25 g, for example, from about 1.5 g to about 30 g, for example from about 3 g to about 22 g, for example, from about 6 g to about 15 g. Ply bond is measured according to the following procedure.

Ply bond strengths reported herein are determined from the average load required to separate the plies of two-ply tissue, towel, napkin, and facial finished products using Ply Bond Lab Master Slip & Friction tester Model 32-90, with high-sensitivity load measuring option and custom planar top without elevator available from: Testing Machines Inc. 2910 Expressway Drive South Islandia, N.Y. 11722; (800)-678-3221; www.testingmachines.com. Ply Bond clamps are available from: Research Dimensions, 1720 Oakridge Road, Neenah, Wis. 54956, Contact: Glen Winkler, Phone: 920-722-2289 and Fax: 920-725-6874. Ply Bond Strength is the average force to separate a 2 layered (plied) finished product of bath tissue or retail towel. The separation of plies is performed in the machine direction over a specified distance between perforations. Samples of retail tissue can be tested at finished product width while retail towel is cut to a 3-in. width. Testing can be performed on a vertical or horizontal type tensile tester that has averaging capabilities. Results are reported as average force/sample width.

Samples are preconditioned according to TAPPI standards and handled only by the edges and corners care being exercised to minimize touching the area of the sample to be tested.

At least ten sheets following the tail seal are discarded. Four samples are cut from the roll thereafter, each having a length equivalent to 2 sheets but the cuts are made ¼" away from the perforation lines by making a first CD cut ¼" before a first perforation and a second CD cut ¼" before the third perforation so that the second perforation remains roughly centered in the sheet. The plies of each specimen are initially separated in the leading edge area before the first perforation continuing to approximately 1 inch past this perforation.

The sample is positioned so that the interior ply faces upwardly, the separated portion of the ply is folded back to a location ½" from the initial cut and ¼" from the first perforation, and creased there. The folded back portion of the top ply is secured in one clamp so that the line contact of the top grip is on the perforation; and the clamp is placed back onto the load cell. The exterior ply of the samples is secured to the platform, aligning the perforation with the line contact of the grip and centering it with the clamp edges.

After ensuring that the sample is aligned with the clamps and perforations, the load-measuring arm is slowly moved to the left at a speed of 25.4 cm/min, for a test length of 16.5 cm and the average load between 5-14 cm on the arm (in g.) is measured and recorded. The average of 3 samples is recorded with the fourth sample being reserved for use in case of damage to one of the first three.

For products having more than two plies follow the same preparation procedure and obtain two samples. Take one sample and test each of the plies starting with the outside ply and removing one sheet at a time until all plies are tested. Each of the individual ply bonds are averaged to obtain the ply bond value in grams. Test the other sample the same way and the average of the two in grams is reported.

The tissue product of the present disclosure has an improved sensory softness. When a sheet is embossed with longer emboss elements, the hands glide over the elements more easily making the tissue product itself feel smoother.

Sensory softness of the samples can be determined by using a panel of trained human subjects in a test area conditioned to TAPPI standards (temperature of 71.2° F. to 74.8° F., relative humidity of 48% to 52%). The softness evaluation relied on a series of physical references with predetermined softness values that were always available to each trained subject as they conducted the testing. The trained subjects directly compared test samples to the physical references to determine the softness level of the test samples. The trained subjects assigned a number to a particular paper product, with a higher sensory softness number indicating a higher perceived softness.

Subjective product attributes, such as sensory softness, are often best evaluated using protocols in which a consumer uses and evaluates a product. In a "monadic" test, a consumer will use a single product and evaluate its characteristics using a standard scale. In paired comparison tests, the consumers are given samples of two different products and asked to rate each vis-à-vis the other for either specific attributes or overall preference. Sensory softness is a subjectively measured tactile property that approximates consumer perception of sheet softness in normal use. Softness is usually measured by 20 trained panelists and includes internal comparison among product samples. The results obtained are statistically converted to a useful comparative scale.

The following examples provide representative embodiment patterns according to the present disclosure. The methods and products described herein should not be limited to the examples provided. Rather, the examples are only representative in nature.

EXAMPLE

A multi-ply product according to the instant disclosure was made using a dual-apex pattern as seen in FIGS. 1-2B. The control was the same tissue base sheets except the elements were kept at a constant line width and the apex was not modified (only a single apex). The control was run on a pilot paper line. The control pattern produced an unacceptable product with significant bunching and puckering.

As described above, the pattern as seen in FIG. 1, while offset from the machine direction still includes significant portions of the continuous emboss elements 20 that align with the MD direction and cause bunching and/or puckering. Introducing a dual-apex resulted in a tissue having runnability without significant bunching or puckering.

Although the present disclosure has been described in certain specific exemplary embodiments, many additional modifications and variations would be apparent to those skilled in the art in light of this disclosure. It is, therefore, to be understood that this invention may be practiced otherwise than as specifically described. Thus, the exemplary embodiments of the invention should be considered in all respects to be illustrative and not restrictive and the scope of the invention to be determined by any claims supportable by this application and the equivalents thereof, rather than by the foregoing description.

What is claimed is:

1. An adhesively bonded multi-ply embossed tissue product comprising, at least two tissue webs, wherein at least one of the tissue webs is embossed with an embossing pattern comprising at least one elongated embossment having a base and an apex and an aspect ratio of at least about 5, wherein the apex of the at least one elongated embossment comprises at least one channel running the length of the embossment dividing the apex into at least two sections;

wherein adhesive is applied to the at least two sections of the apex of the at least one elongated embossment and not to the at least one channel running the length of the at least one elongated embossment; and wherein the at least two tissue webs are bonded by the adhesive applied to the at least two sections of the apex of the at least one elongated embossment and are not bonded at the at least one channel.

2. The tissue product of claim 1, wherein the apex comprises at least two channels resulting in at least three apex sections.

3. The tissue product of claim 1, wherein the at least one elongated embossment has an aspect ratio of at least about 20.

4. The tissue product of claim 1, wherein the at least one elongated embossment has an aspect ratio of at least about 50.

5. The tissue product of claim 1, wherein the at least one elongated embossment is a continuous embossment.

6. The tissue product of claim 1, wherein the at least one elongated embossment comprises a series of continuous embossments that form a series of cells.

7. The tissue product of claim 1, wherein the width of the at least one channel is at least about 10% of the total width of the apex.

8. The tissue product of claim 1, wherein the width of the at least one channel is at least about 35% of the total width of the apex.

9. The tissue product of claim 1, wherein the width of the at least one channel is from about 20% to about 50% of the total width of the apex.

10. A method for making a multi-ply tissue product comprising:

forming at least two tissue webs;

embossing at least one of the tissue webs with an embossing pattern comprising at least one elongated embossment having a base and an apex and an aspect ratio of at least about 5;

wherein the apex of the at least one elongated embossment comprises at least one channel running the length of the embossment dividing the apex into at least two sections;

applying adhesive to the at least two sections of the apex of the at least one elongated embossment and not to the at least one channel running the length of the at least one elongated embossment; and adhesively bonding the two tissue webs to form a multi-ply tissue product, wherein the at least two tissue webs are bonded by the adhesive applied to the at least two sections of the apex of the at least one elongated embossment and are not bonded at the at least one channel.

11. The method of claim 10, wherein the at least one tissue web with the embossing pattern comprising the at least one elongated embossment was dried on a structured drying fabric during formation.

12. The method of claim 11, wherein the embossing of the at least one of the tissue webs comprises passing the at least one base sheet between a steel roll bearing the emboss pattern and a rubber roll.

13. The method of claim 10, wherein the apex comprises at least two channels resulting in at least three apex sections.

14. The method of claim 10, wherein the at least one elongated embossment has an aspect ratio of at least about 20.

15. The method of claim 10, wherein the at least one elongated embossment has an aspect ratio of at least about 50.

16. The method of claim 10, wherein the at least one elongated embossment is a continuous emboss element.

17. The method of claim 10, wherein the at least one elongated embossment comprises a series of continuous embossments that form a series of cells.

18. The method of claim 10, wherein the width of the at least one channel is at least about 10% of the total width of the apex.

19. The method of claim 10, wherein the width of the at least one channel is at least about 35% of the total width of the apex.

20. The method of claim 10, wherein the width of the at least one channel is from about 20% to about 50% of the total width of the apex.

* * * * *